US005183183A

United States Patent [19]

Hernandez

[11] Patent Number: 5,183,183

[45] Date of Patent: Feb. 2, 1993

[54] BOTTLE SLING APPARATUS

[76] Inventor: Trinidad Hernandez, 8467 Oleander Ave., Fontana, Calif. 92335

[21] Appl. No.: 811,848

[22] Filed: Dec. 23, 1991

[51] Int. Cl.[5] ..... B67D 5/64

[52] U.S. Cl. ..... 222/175; 222/464; 366/260; 366/332; 224/148; 215/1 A; 215/229; 215/DIG. 8; 220/709; 206/221; 99/287

[58] Field of Search ..... 222/175, 464; 215/DIG. 8, 229, 1 A; 220/709; 206/219, 221; 224/148; 99/287; 366/242, 260, 332

[56] References Cited

U.S. PATENT DOCUMENTS

| | | | |
|---|---|---|---|
| 2,291,708 | 8/1942 | Gluck | 366/260 |
| 3,445,046 | 5/1969 | Wilson | 224/148 |
| 3,820,695 | 6/1974 | Pecjak | 224/148 |
| 3,927,608 | 12/1975 | Doyel | 99/287 X |
| 4,306,492 | 12/1981 | Zimmermann | 99/287 |
| 4,852,762 | 8/1989 | Chou-Sheng | 220/709 |
| 4,852,781 | 8/1989 | Shurnick et al. | 224/148 |
| 5,048,705 | 9/1991 | Lynd et al. | 220/709 X |
| 5,060,835 | 10/1991 | Payne | 224/148 X |
| 5,076,425 | 12/1991 | Plone | 206/221 X |

FOREIGN PATENT DOCUMENTS

| | | | |
|---|---|---|---|
| 2615078 | 11/1988 | France | 224/148 |

*Primary Examiner*—Gregory L. Huson
*Attorney, Agent, or Firm*—Hugh E. Smith

[57] ABSTRACT

A bottle sling formed of a flexible web is arranged in surrounding and engaging securement relative to a drinking container, with a support ring mounting a flexible strap adjacent an upper distal end of the container for support of the web of the container about an individual's torso portion. A modification of the invention includes an agitator pump arranged within the fluid coaxially of a drinking tube directed through the container and a flavored tablet dispenser in communication with an interior portion of the container for projecting flavoring tablets within the container.

3 Claims, 4 Drawing Sheets

BOTTLE SLING APPARATUS

BACKGROUND OF THE INVENTION

1. Field of the Invention

The field of invention relates to container apparatus, and more particularly pertains to a new and improved bottle sling apparatus wherein the same is arranged for the ease of transport and manipulation of a container.

2. Description of the Prior Art

Various support structure and flexible bag members are arranged throughout the prior art for the transport of various components therewithin. An example is set forth in U.S. Pat. No. 4,852,778 to Beisier, et al. wherein a bicycle bag and handbag combination is arranged for selective securement to a bicycle or to an individual during transport thereof.

U.S. Pat. No. 4,830,154 to Gerch, et al. sets forth a duffle bag arranged with a plurality of pockets therewithin for containing various components within the bag structure.

U.S. Pat. No. 4,428,508 to Gardikas sets forth a water bottle formed with an elongate container and a drinking tube directed coaxially of the container.

U.S. Pat. No. 4,703,927 to Hanzlik sets forth a jogger's hand weight and water bottle combination for drinking.

As such, it may be appreciated that there continues to be a need for a new and improved bottle sling apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of container apparatus now present in the prior art, the present invention provides a bottle sling apparatus wherein the same is arranged for the ease of transport and manipulation of a fluid container. As such, the general purpose of the present invention, which will be described subsequently in greater detail, is to provide a new and improved bottle sling apparatus which has all the advantages of the prior art container apparatus and none of the disadvantages.

To attain this, the present invention provides a bottle sling formed of a flexible web arranged in surrounding and engaging securement relative to a drinking container, with a support ring mounting a flexible strap adjacent an upper distal end of the container for support of the web of the container about an individual's torso portion. A modification of the invention includes an agitator pump arranged within the fluid coaxially of a drinking tube directed through the container and a flavored tablet dispenser in communication with an interior portion of the container for projecting flavoring tablets within the container.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved bottle sling apparatus which has all the advantages of the prior art container apparatus and none of the disadvantages.

It is another object of the present invention to provide a new and improved bottle sling apparatus which may be easily and efficiently manufactured and marketed.

It is a further object of the present invention to provide a new and improved bottle sling apparatus which is of a durable and reliable construction.

An even further object of the present invention is to provide a new and improved bottle sling apparatus which is susceptible of a low cost of manufacture with regard to both materials and labor, and which accordingly is then susceptible of low prices of sale to the consuming public, thereby making such bottle sling apparatus economically available to the buying public.

Still yet another object of the present invention is to provide a new and improved bottle sling apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
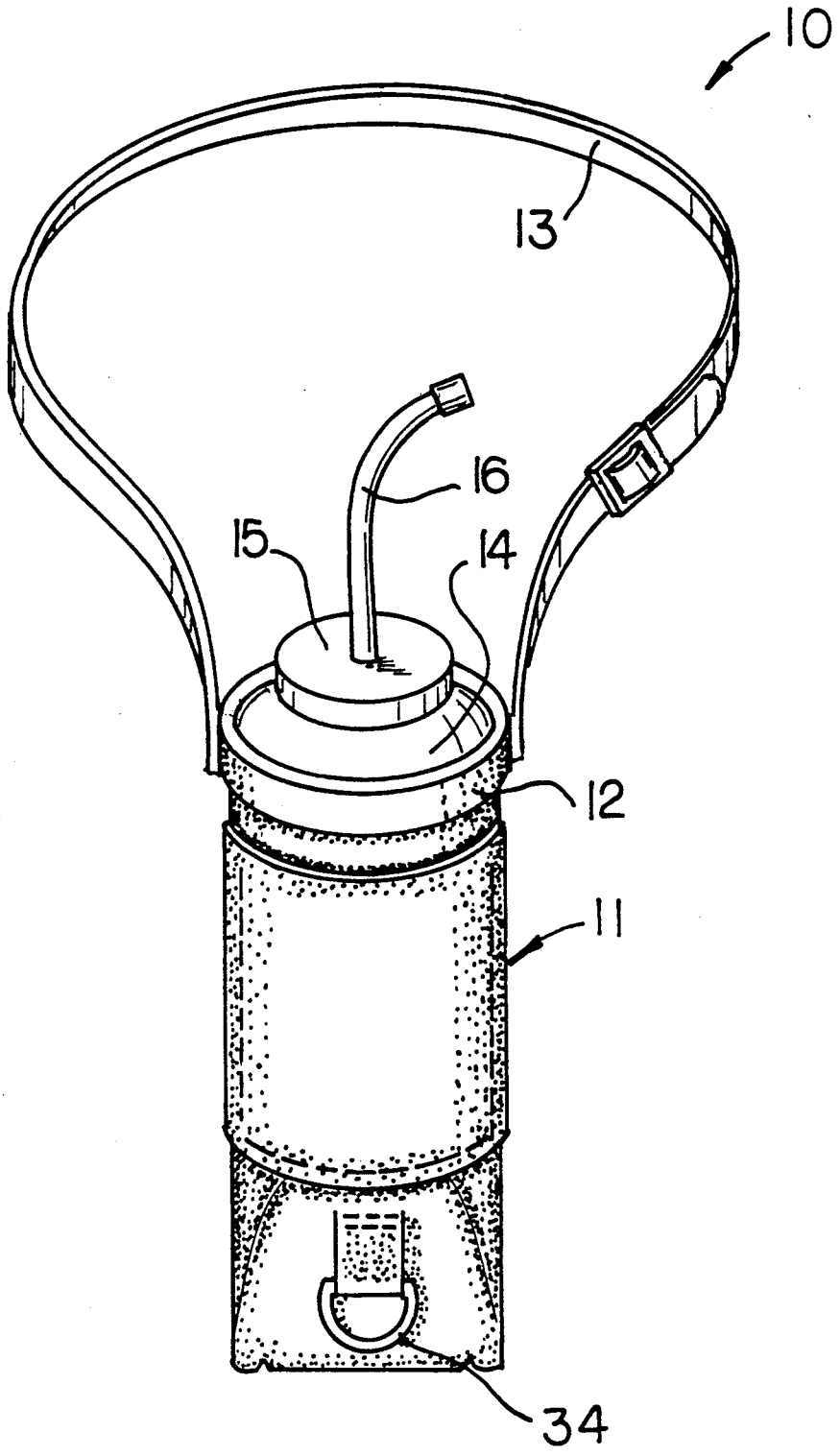
FIG. 1 is an isometric illustration of the instant invention.
Figure 2:
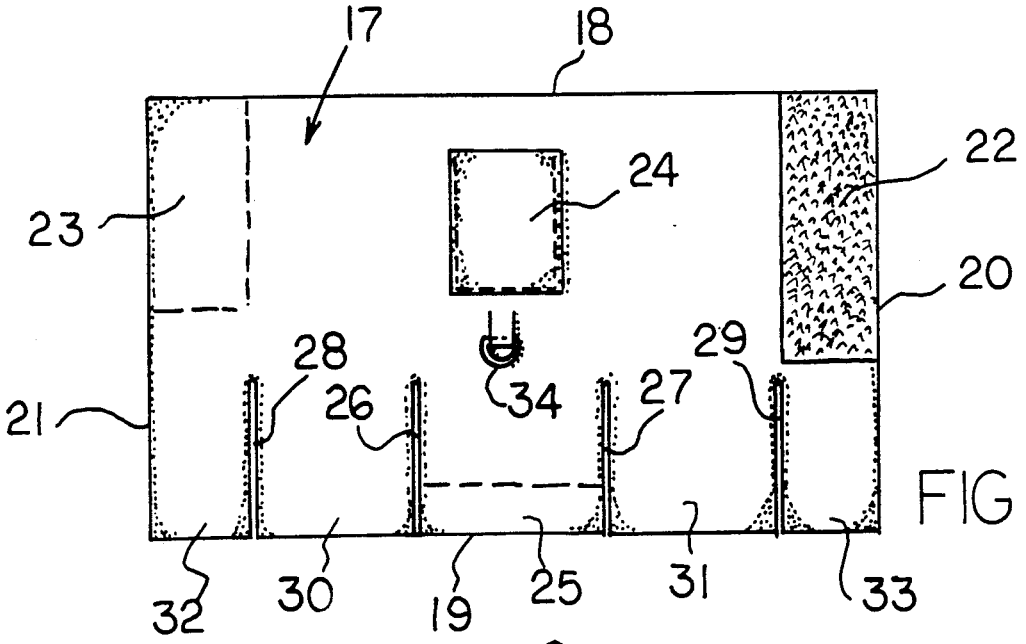
FIG. 2 is an orthographic plan view of the flexible web utilized in the pouch assembly of the invention.

With reference now to the drawings, and in particular to FIGS. 1 to 7 thereof, a new and improved bottle sling apparatus embodying the principles and concepts of the present invention and generally designated by the reference numerals 10, 10*a*, and 10*b* will be described.

More specifically, the bottle sling apparatus 10 of the instant invention essentially comprises a pouch assembly 11 receiving an elongate fluid container 14 therewithin. A mounting ring 12 is fixedly mounted to an upper distal end of the pouch assembly 11, with a flexible strap 13 diametrically mounted on opposed sides to the ring, with the strap member 13 adjustable for mounting about an individual's torso portion and the like. The fluid container 14 includes a fluid container cap 15, with a drinking tube 16 coaxially directed through the cap.

Figure 3:
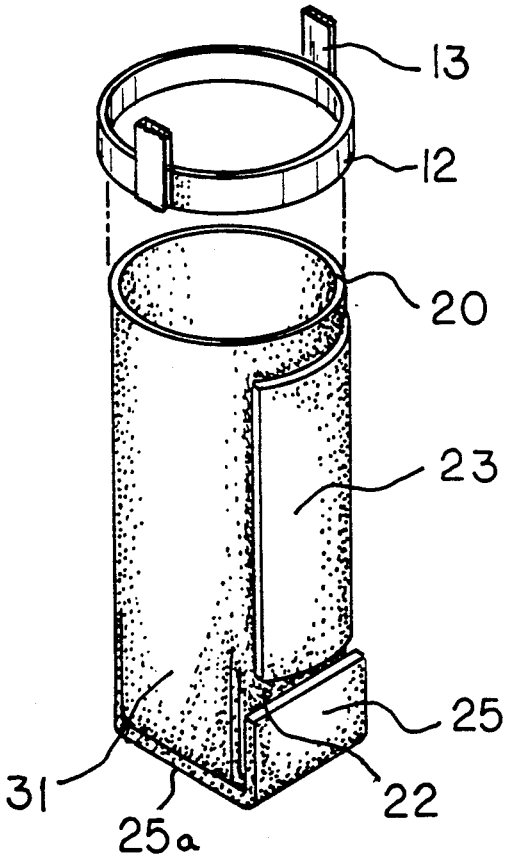
FIG. 3 is an isometric illustration of the pouch assembly.
Figure 4:
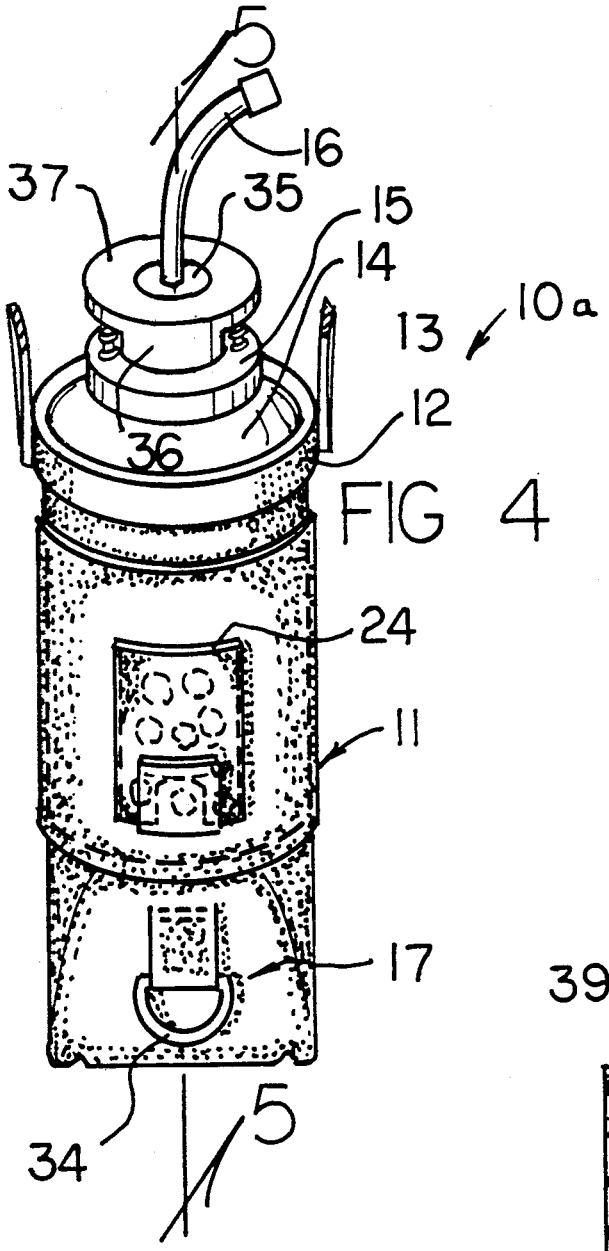
FIG. 4 is an isometric illustration of a modification of the invention.

The pouch assembly 11 is formed of a flexible pouch web 17 (see FIG. 2) that is defined with a first side edge 18 spaced from and parallel a second side edge 19, and a first end edge 20 spaced from and parallel a second end edge 21. A first hook and loop fastener patch 22 of a first length extends from the first side edge 18 along the first end edge 20 a predetermined first length, with a second hook and loop fastener patch 23 mounted to a reverse side of the web 17 extending from the first side edge 18 along the second end edge 21 a predetermined second length less than the first length. The first pocket 24 is mounted medially of the web adjacent the first side edge 18 to further include a mounting ring 34 supportive of keys and the like therewithin. The first pocket 24 is provided to includes storage for various items such as salt tablets and the like, such as illustrated in FIG. 4. As illustrated in FIG. 4, a second pocket 24*a* surmounted over the first pocket 24 is provided to receive identification items and the like for identification of an individual, such as a child. A first flap 25 is positioned medially between the first and second end edges 20 and 21 extending from the second side edge 19 to include a third hook and loop fastener patch portion mounted to a bottom side of the web 17, with the first flap 25 including a first flap extension 25*a* extending towards the first side edge 18 to position adjacent a forwardmost extent of the first hook and loop fastener patch 22 and position between respective first and second slits 26 and 27. Third and fourth slits 28 and 29 parallel to the respective first and second slits 26 and 27 and adjacent the respective slits define respective second and third flaps 30 and 31 between the first and third slits and the second and fourth slits respectively. A fourth and fifth flap 32 and 33 is defined between the respective third slit and second end edge and the fourth slit and the first end edge respectively. The first through fifth flaps are interfolded in a manner as illustrated in FIG. 3, with the first flap 25 arranged for engaging a lowermost extent of the first hook and loop fastener patch 22 subsequent to the first hook and loop fastener patch engaged with the second hook and loop fastener patch to define a tubular patch assembly 11, as illustrated in FIG. 3.

Figure 5:
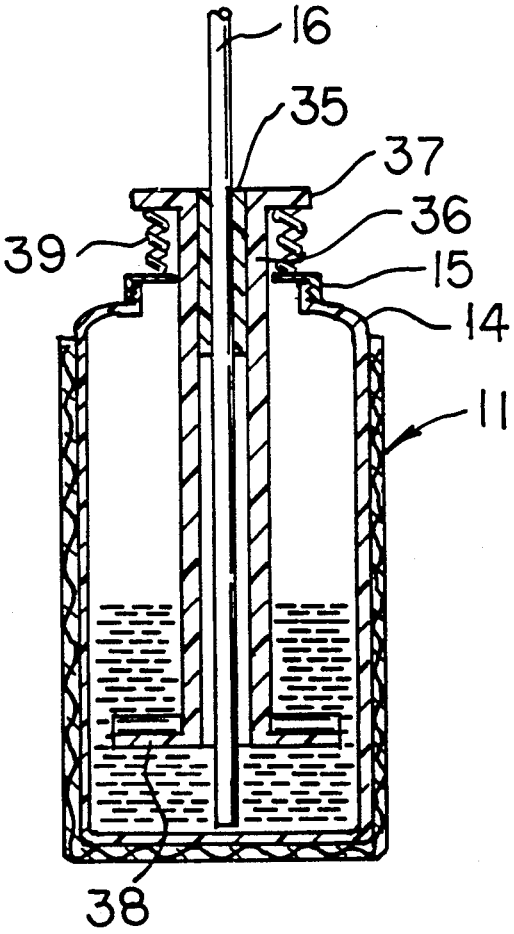
FIG. 5 is an orthographic view, taken along the lines 5—5 of FIG. 4 in the direction indicated by the arrows.

The apparatus 10*a*, as illustrated in the FIGS. 4 and 5, includes drinking tube support bushing 35 fixedly receiving the drinking tube 16 therethrough, with the drinking tube support bushing 35 slidably mounted within a bushing tube 36 that includes a top flange 37 spaced above the container cap 15 capturing a plurality of spring members 39 therebetween. A bottom flange 38 is positioned orthogonally relative to a lower distal end of the bushing tube 36, whereupon depressing of the bushing tube top flange 37 effects agitation of fluid within the container 14.

Figure 6:
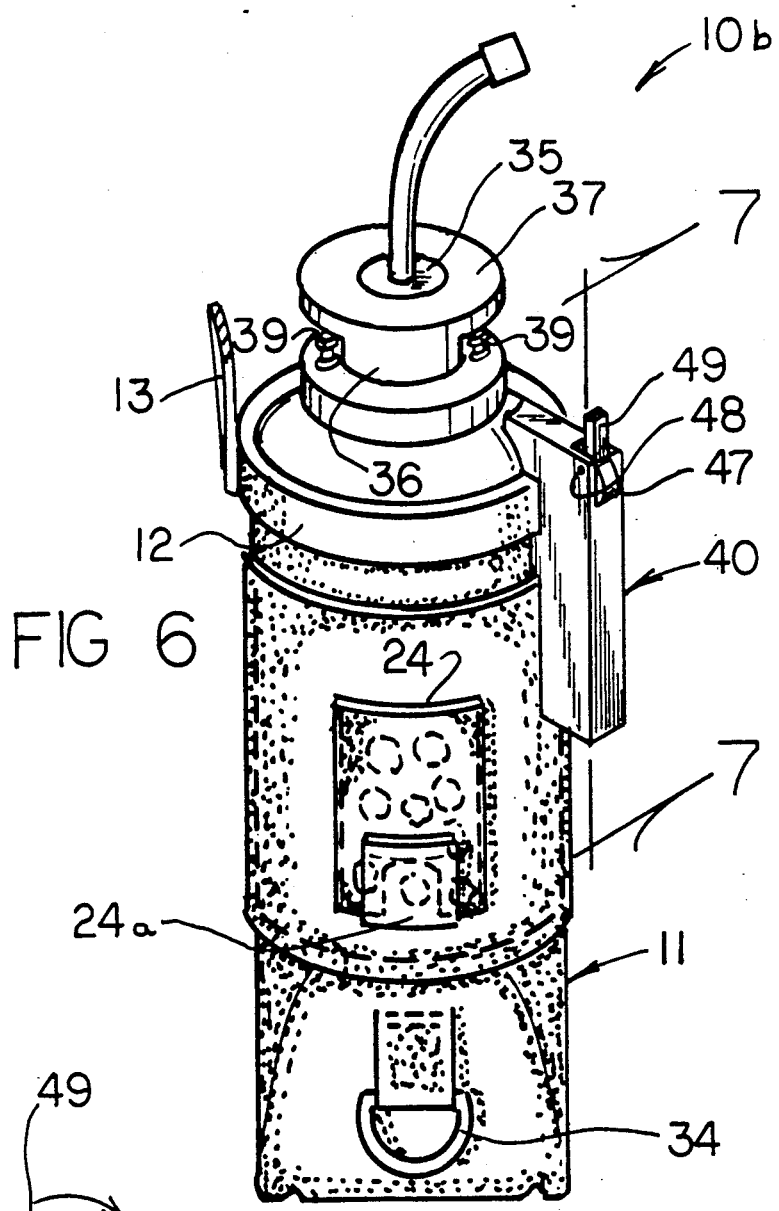
FIG. 6 is an isometric illustration of a further modification of the invention.
Figure 7:
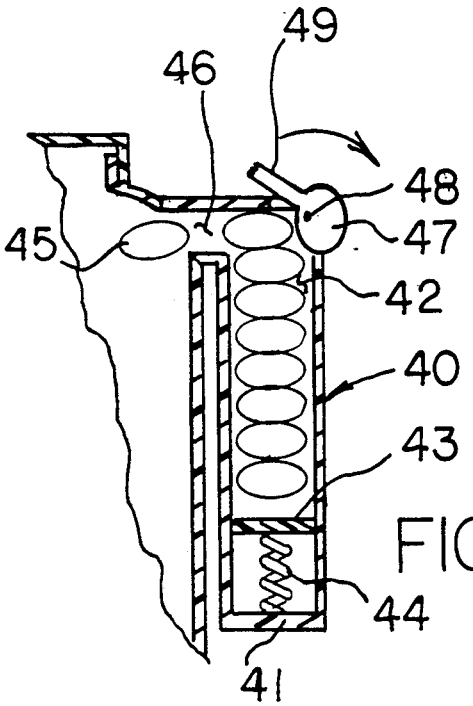
FIG. 7 is an orthographic view, taken along the lines 7—7 of FIG. 6 in the direction indicated by the arrows.

The apparatus 10*b*, as illustrated in the FIGS. 6 and 7, further includes a dispenser housing 40 mounted to the container 14 to include a dispensing housing conduit 46 communicating at an upper distal end of a dispenser housing well 42 with an interior cavity portion of the container 14. The dispenser housing 40 includes a housing floor spaced below a presser plate 43 mounted within the well, with a presser plate spring 44 captured between the presser plate and the housing floor to bias a column of flavored tablets 45. A cam ejector 47 mounted to an upper distal end of the well spaced from and aligned with the housing conduit 46 is pivotally mounted about a cam axle 48, with a cam handle 49 fixedly mounted to the cam ejector 47 to permit selective rotation of the cam ejector, where the cam upon rotation engages a fluid 45 to eject a tablet through the housing conduit 46 into the container cavity for mixture with the associated fluid within the container to position such fluid in utilizing the bushing tube bottom flange 38 and reciprocating the same through the top flange 37, a mixture of the fluid soluble table 45 with the fluid within the container effects selective flavoring of the fluid for the entertainment and amusement of children and the like. Further, such tablets may be formed as nutrient mixtures to provide nutrients by athletes and the like requiring fluid during physical expenditure and activity.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the U.S. is as follows:

1. A bottle sling apparatus, comprising, a flexible pouch assembly, the pouch assembly including a first end edge spaced from a second end edge, with the second end edge selectively securable overlying the first end edge, and a first side edge spaced from a second side edge, the second side edge including a first flap securable to the pouch assembly medially of the first end edge and the second end edge, and a fluid container received within the pouch assembly, and a mounting ring secured about an upper distal end of the pouch assembly, with the mounting ring including a flexible strap member mounted to diametrically opposed sides of the mounting ring, and the fluid container including a fluid container cap, and a drinking tube directed through the cap extending into the fluid container, and including a first pocket mounted to an exterior surface of the patch assembly below the mounting ring, where the first pocket includes a second pocket securable in a surmounted relationship relative to the first pocket, and a mounting ring positioned below the first pocket and the second pocket, and the drinking tube is coaxially directed through the container cap, and a drinking tube support bushing fixedly receives the drinking tube therethrough, and a bushing tube slidably receiving the drinking tube support bushing, the bushing tube slidably received through the container cap in surrounding relationship relative to the drinking tube support bushing, and the bushing tube including a top flange spaced above the container cap, and a bottom flange positioned within the container, and at least one spring member captured between the top flange and the container cap.

2. An apparatus as set forth in claim 1 including a dispenser housing fixedly mounted to the container projecting exteriorly thereof, wherein the dispenser housing includes a dispenser housing well, and the well including a housing floor at a lower distal end of the well, and a dispenser housing conduit positioned at an upper end of the well in communication with an interior cavity of the container, and a presser plate reciprocatably mounted within the well spaced above the housing floor, and a presser plate spring captured between the presser plate and the housing floor, and a column of tablets contained within the well above the presser plate, and an ejector member mounted at an upper distal end of the well spaced from the dispenser housing conduit.

3. An apparatus as set forth in claim 2 wherein the ejector member includes a cam member pivotally mounted about a cam axle, wherein the cam axle is mounted to the dispenser housing adjacent an upper distal end of the well, and a handle fixedly mounted to the cam ejector permitting rotation of the cam ejector relative to the well to effect projection of a tablet through the dispenser housing conduit.

* * * * *